US005125219A

United States Patent [19]

Sligo

[11] Patent Number: 5,125,219

[45] Date of Patent: Jun. 30, 1992

[54] HORSE CINCH

[76] Inventor: Jeffrey B. Sligo, HC 73, Box 140, St. Lawrence, S. Dak. 57373

[21] Appl. No.: 698,973

[22] Filed: May 13, 1991

[51] Int. Cl.[5] ..... B68C 1/14

[52] U.S. Cl. ..... 54/23

[58] Field of Search ..... 54/23, 35, 46

[56] References Cited

U.S. PATENT DOCUMENTS

| | | | |
|---|---|---|---|
| 199,318 | 1/1878 | Sanford | 54/23 |
| 299,995 | 6/1984 | McGuire | 54/23 |
| 3,289,389 | 3/1965 | Herrara | 54/23 |
| 3,466,852 | 1/1967 | Stoner | 54/65 |
| 3,805,491 | 4/1974 | Deal | 54/23 |
| 4,125,904 | 11/1978 | Levine | 2/267 |
| 4,147,015 | 4/1979 | Land | 54/23 |
| 4,434,604 | 3/1984 | Bird | 54/23 |
| 4,570,424 | 2/1986 | Simpson | 54/46 X |
| 4,575,874 | 3/1986 | Johnson | 2/268 |
| 4,905,458 | 3/1990 | Johnston | 54/23 |
| 4,978,044 | 12/1990 | Silver | 224/202 |

*Primary Examiner*—Robert P. Swiatek
*Attorney, Agent, or Firm*—Haugen and Nikolai

[57] ABSTRACT

A Western horse cinch having reinforcing webbing along an exterior surface and a removable fleece liner along an interior surface is disclosed. The cinch is approximately four and one-half inches wide and 32 and one-half inches long. A strip of four inch wide Velcro TM fabric lines the inner surface of the entire length of a four inch span of webbing which forms the body of the cinch. A standard piece of padded fleece fabric has a strip of complementary Velcro TM running its entire length. Thus, the fleece fabric is easily removable from the strip of webbing for washing. A second piece of webbed fabric is stitched the length of the cinch and is looped to retain a four inch D-ring at each end. It also has a narrow strip of webbing placed at the center (mid-section) which holds two opposing one-inch D-rings in place. These smaller D-rings are used for attachment of a breast collar or breast plate and a flank strap. The present invention includes one additional strip of webbing which holds a webbed cuff at each end. These cuffs are approximately two and one-half inches wide and of a size adequate to receive the leather straps included on most Western saddles.

8 Claims, 1 Drawing Sheet

HORSE CINCH

BACKGROUND OF THE INVENTION

I. Field of the Invention

This invention relates generally to the design of horse cinches, and more particularly to an improved Western horse cinch having a removable fleece liner and multiple layers of reinforcing webbing. Thus, the cinch features enhanced strength and durability as well as a fleece liner which can be removed for washing.

II. Description of the Prior Art

Cinches for Western or Australian-type saddles typically feature a strap with a D-ring or an O-ring at each end. Alternatively, a buckle may be placed at opposing ends of the cinch. These buckles or rings are dimensioned to receive straps which extend from the underside of the saddle. The saddle straps, in turn, are mounted to the underside of the saddle by a similar rounded ring. The saddle straps are looped between the rounded saddle rings and the buckles or rings on the cinch. Once pulled tight, the combination holds the saddle securely in place.

U.S. Pat. No. 4,905,458, issued to Johnston, et al. on Mar. 6, 1990, discloses a Western saddle girth. It features a band of a length sufficient to completely encircle the animal about its midsection. The inside of the circle is lined with grippers which help secure the band by friction against the hair of the animal. The exterior top portion of the band has a length of Velcro® and the saddle is fitted with a complementary piece of Velcro® on its underneath surface, so that when the two are placed together, the Velcro® greatly assists maintaining the saddle in proper position. Two sets of conventional buckles are positioned on the band at opposing sides so that the conventional leather straps provided with most Western saddles can be affixed to these buckles.

U.S. Pat. No. 4,570,424, issued to Simpson on Feb. 18, 1986, discloses another cinch for a Western saddle. It is lined with fleece and reinforced with webbing. Most Western saddles currently being sold have a leather or webbed strap for attachment to a cinch strap, and some have an additional strap attached at the rear of the saddle for attachment of what is called a flank strap. This design combines both cinch and flank attachments into one piece of fleece-lined equipment. A reinforced piece of webbing is used to attach two D-rings to the midsection of the cinch strap. The flank strap is actually comprised of two pieces of reinforced webbing, both of which extend from one of the D-rings at the midsection of the cinch strap.

U.S. Pat. No. 4,174,015, issued to Land on Apr. 3, 1979, discloses yet another Western saddle cinch design. It features a girth buckle and D-ring configuration similar to the Simpson '424 design and a fleece-lined support webbing that runs the entire length of the girth. Perpendicularly positioned at the midsection of this underlying webbing is a short strip of narrow webbing holding two opposing D-rings. A loop of webbing holding a girth buckle at each end is positioned on top of the underlying support webbing and sewn into place so that the girth buckles are recessed a short distance from the ends of the support webbing.

U.S. Pat. No. 3,805,491, issued to Deal on Apr. 23, 1974, discloses a reinforced webbing cinch. This cinch includes a webbing assembly having a pair of longitudinal straps extending in parallel relation between and around the straight bars on a pair of cinch buckles, then inclined to cross over and extend to the outside at the center, with ends of each strap overlapped at the center. It has a girth buckle at each end and circular rings on a narrow strap at the midsection for attachment of both a breast collar strap and a flank cinch strap. The webbing assembly is enclosed by a double-walled cover having an olefin or similar pile on the outside and angular extensions at the center, both to the front and rear, conforming in shape to the webbing assembly. These extensions provide a greater bearing area for the cinch and minimize interference with the horse's legs. The cover also has slots on the under side, through which the respective buckles and rings extend, thereby providing adequate padding for these buckles and rings.

U.S. Pat. No. 4,125,904, issued to Levine on Nov. 21, 1978, discloses a shoulder strap pad. This pad features a soft base provided with a nonslip lower surface, a cover snap-fastened to the base adjacent the strap edges, and a veneer, removably attached to the upper surface of the cover. The material selected for the upper surface of the cover matches the bag with which the shoulder strap is used and is lined with Velcro® so that the covers may be interchanged.

SUMMARY OF THE INVENTION

Cinches of various types for Western saddles are well known in the saddle art. However, prior art cinches have proven to be difficult to clean. This is especially true of the portion of the cinch which contacts the animal. This portion invariably becomes caked with dirt, grime and sweat. Washing prior art cinches by hand is generally very time consuming, unpleasant and ineffective. The heavy metal portions of such prior art cinches make it inappropriate to use a washing machine to wash such cinches. Rather than risk damage to the washing machine, users simply discard the cinch.

Prior art webbed cinches have also shown an additional problem of durability in the use of the synthetic webbing. The fabric currently available for webbing tends to fray and wear through on its edges as the upper leathers of the saddle rub against it. The present invention provides an additional layer of webbing to further reinforce the body of the cinch. Thus, the present invention was developed to specifically resolve these limitations inherent in prior art cinches, as well as provide a relatively low-cost device.

According to one embodiment of the present invention, there is provided an improved Western-type horse cinch, having a removable fleece liner and three layers of reinforcing webbing. The typical cinch would be approximately four and one-half inches wide and 32 and one-half inches long. The recitation of these dimensions, however, is not intended to be limiting. A strip of four inch wide Velcro® fabric lines the inner surface of the entire length of a four inch span cf webbing which forms the body of the cinch. A standard piece of padded fleece fabric has a strip of complementary Velcro® running its entire length. Thus, the fleece fabric is easily removable from the strip of webbing for washing. A second piece of webbed fabric is stitched the length of the cinch and is looped to retain a four inch D-ring at each end. It also has a narrow strip of webbing placed at the center (midsection) which holds two opposing one-inch D-rings in place. These smaller D-rings are used for attachment of a breast collar or breast plate and a flank strap. The present invention includes one additional strip of webbing which holds a webbed cuff at each end. These cuffs are approximately two and one-half inches wide and of a size adequate to receive the leather straps included on most Western saddles.

It is accordingly a principal object of the present invention to provide a new and improved Western saddle cinch featuring the added comfort of a fleece lining, wherein the fleece is removable and washable.

Another object of the present invention is to provide a new and improved Western saddle cinch wherein fleece liners are interchangeable.

It is yet another object of the present invention to provide a new and improved Western saddle cinch featuring looped webbing for receiving excess leather straps hanging from the saddle.

A further object of the present invention is to provide a new and improved apparatus for controlling sanitation as saddles are switched between animals.

Other objects of the present invention and many of its attendant advantages will be more readily appreciated as the invention becomes better understood by reference to the following detailed description when considered in connection with the accompanying drawings in which like reference numerals designate like parts throughout.

DESCRIPTION OF THE PREFERRED EMBODIMENT

Figure 1:
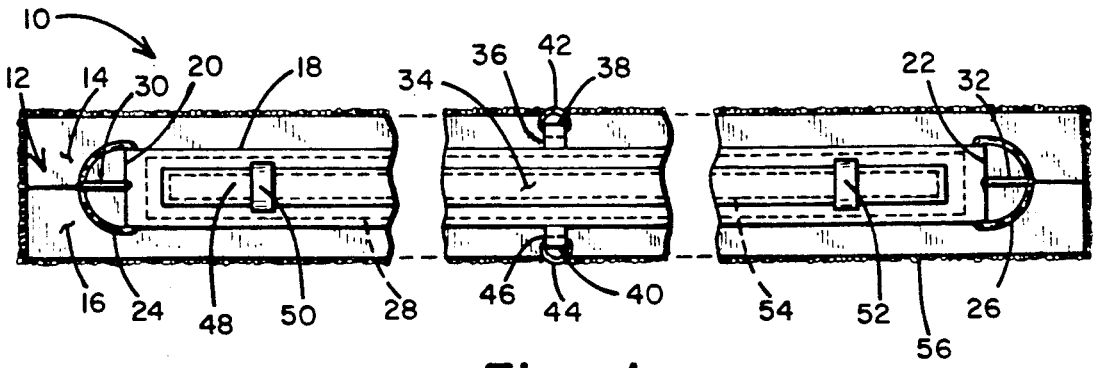
FIG. 1 depicts a plan view of the horse cinch of the present invention.

A preferred embodiment of the horse cinch incorporating the present invention is shown in the plan view of FIG. 1. Generally depicted as 10, the horse cinch features a base web 12. The base web 12 will typically be of a leather or synthetic webbing material. Although described herein in terms of webbing, it is to be understood that these materials are interchangeable. Typical dimensions for base web 12 would be 4 inches wide by 33 inches long. The base web 12 may be made of a single piece of material or a plurality of pieces sewn together such as strips 14 and 16. Sewn over the base web 12 is an intermediate web 18 terminating approximately 6 inches from each end of base web 12.

The intermediate web 18 has ends 20 and 22 which are turned under to form sleeves to receive metal D rings 24 and 26. Although D rings are depicted, it is to be understood that metal circles, buckles or other securing devices as known in the saddle art may also be used at ends 20 and 22. It is to be further understood that D rings 24 and 26 may include tongues 30 and 32 to aid in attaching the girth to a leather strap leading from the saddle.

Reinforcing stitching 28 permanently affixes the intermediate web 18 to the underlying base web 12. A suggested width for the intermediate web 18 is approximately 3.5 inches.

Centrally positioned at mid-section 34 of the horse cinch of the present invention is a narrow cross web 36. Web 36 can be made approximately 1 inch in width. Web 36 is also turned under at ends 38 and 40 to secure small D rings 42 and 44 for the attachment of other equipment. Reinforcing stitching 46 further secures this web 36 to intermediate web 18 and secures D rings 42 and 44 in proper position.

Still another outer web 48 is secured to intermediate web 18. Web 48 terminates approximately 1 to 2 inches from D rings 24 and 26. It is suggested that web 48 be approximately 2 inches in width and be fitted with retaining sleeves 50 and 52 of similar material. Retaining sleeves 50 and 52 are each positioned approximately 6 inches from the E rings 24 and 26. A portion of each sleeve 50 and 52 is held between web 48 and intermediate web 18 and is further secured by reinforcing stitching 54.

Figure 2:
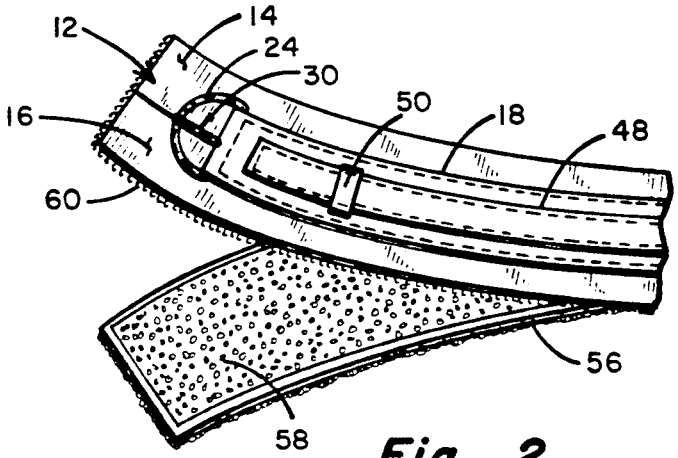
FIG. 2 depicts a plan view of the present invention showing the hook and loop type closure used to secure the fleece liner to the mesh portion of the cinch.

An important element of the present invention is the fleece liner 56 which runs the entire length of the base web 12. FIG. 2 is intended to show the fleece liner 56 and how it is removably attached to base web 12. The entire length of the fleece liner 56 is fitted with a loop receiving mesh 58. The loop receiving mesh 58 is intended to mate a hook mesh 60 which is stitched the entire length of the base web 12. This hook and loop-type fastening means is commercially available under the Velcro ® trademark. As should be readily apparent from the drawing, the use of this fastening means makes it possible to separate the fleece liner 56 from the base web 12 for machine washing without fear that other parts of the device will damage the machine All metal parts which might cause such damage remain with base web 12.

Figure 3:
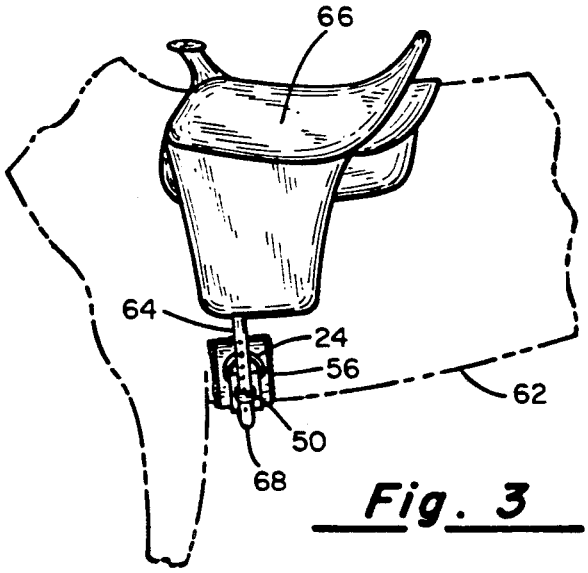
FIG. 3 depicts the present invention in a typical application.

The horse cinch of the present invention is depicted in use in FIG. 3. The fleece liner 56 is placed alongside the animal's underbelly 62 and leather straps 64 provided with most Western saddles may be slipped through D rings 24 and 26 to secure the saddle in place. These leather straps 64 are wrapped repeatedly from the cinch D rings 24, 26 to similar rings provided on the saddle 66 until only a short length of leather strap remains free. The free end 68 of this remaining length is then inserted through the retaining loops 50 or 52. Thus, they do not hang freely and interfere with the movement of the horse.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices and that various modifications, both as to equipment details and operating procedures, can be accomplished without departing from the scope of the invention itself.

What is claimed is:

1. A cinch for use with cinch straps from a Western saddle to affix the saddle to the back of an animal a comprising in combination:

a base web having an upper surface, a lower surface, a first end and a second end;

attached to said base web, an intermediate web having an upper surface, a lower surface, a third end and a fourth end, the lower surface cf said intermediate web being in face-to-face registration with the upper surface of said base web, a first securing means attached to said third end and a second securing means attached to said fourth end;

attached to said intermediate web, an outer web having an upper surface, a lower surface, a fifth end, and a sixth end, said lower surface being in face-to-face registration with the upper surface of said intermediate web and affixed to said upper surface of said intermediate web;

a fleece liner fastening means for removably fastening a fleece liner to the lower surface of said base web, said fleece liner fastening means including a hook mesh member and a loop mesh member, one of said mesh members permanently attached to said fleece liner and the other of said mesh members permanently attached to the lower surface of said base web.

2. The cinch as in claim 1, further including a cross web having seventh and eighth ends, and affixed to said intermediate web between the third and fourth ends, and further including securing means at said seventh and eighth ends for attachment of equipment.

3. The cinch as in claim 1, further including securing means positioned around said outer web for receiving said cinch straps.

4. The cinch as in claim 3, wherein said securing means for receiving said cinch straps is comprised of a pair of strips of fabric, each having first and second ends and deformed so said first end and said second end of each strip of fabric are inserted between said intermediate web and said outer web.

5. A cinch for use with cinch straps from a Western saddle to affix the saddle to the back of an animal, comprising in combination:

a first web member having an upper surface, a lower surface, and first and second ends with an intermediate section between said first and second ends a second web member having an upper surface, a lower surface, third and fourth ends, and a centrally positioned midsection, said lower surface of said second web member affixed to said upper surface of said first web member, said second web member also extending to a length wherein said third and fourth ends of said second member web lie within the intermediate section of said first web member;

a means for buckling a cinch strap to said cinch, affixed to each of said third and fourth ends of said second web member;

a third web member having fifth and sixth ends and affixed to said upper surface of said second web member; and a fleece liner means, extending along said lower surface of said first web member from said first end to said second end and having a surface of Velcro® fabric for temporarily attaching said fleece liner means to said lower surface of said first web member.

6. The cinch as in claim 5, further including a fourth web member having seventh and eighth ends, and affixed at said midsection of said second web member, and further including means at each of said seventh and eighth ends for attachment of straps from other, related equipment.

7. The cinch as in claim 5 further including loop means positioned around said third web member for receiving said cinch straps.

8. The cinch as in claim 7, wherein said loop means for receiving said cinch straps is comprises of a pair of lengths of fabric, each having first and second ends and deformed so said first end and said second end of each length of fabric are inserted between said second web member and said third web member.

* * * * *

UNITED STATES PATENT AND TRADEMARK OFFICE

CERTIFICATE OF CORRECTION

PATENT NO. : 5,125,219

DATED : June 30, 1992

INVENTOR(S) : Jeffrey B. Sligo

It is certified that error appears in the above-identified patent and that said Letters Patent is hereby corrected as shown below:

Column 6, Claim 8, Line 29, delete "comprises" and insert -- comprised --.

Signed and Sealed this

Tenth Day of August, 1993

*Attest:*

Michael K. Kirk

MICHAEL K. KIRK

*Attesting Officer*

*Acting Commissioner of Patents and Trademarks*